US006203455B1

(12) United States Patent
Scherubl

(10) Patent No.: US 6,203,455 B1
(45) Date of Patent: Mar. 20, 2001

(54) RACKET WITH DAMPING ELEMENT IN NECK AREA

(75) Inventor: Franz Scherubl, Straubing (DE)

(73) Assignee: Volkl Tennis GmbH, Baar (CH)

( * ) Notice: Subject to any disclaimer, the term of this patent is extended or adjusted under 35 U.S.C. 154(b) by 0 days.

(21) Appl. No.: 09/362,716

(22) Filed: Jul. 29, 1999

(30) Foreign Application Priority Data

Aug. 2, 1998 (DE) ..... 298 13 708 U

(51) Int. Cl.[7] ..... A63B 49/02
(52) U.S. Cl. ..... 473/521; 473/520; 473/546
(58) Field of Search ..... 473/519, 520, 473/521, 524, 546, FOR 171, FOR 181

(56) References Cited

U.S. PATENT DOCUMENTS 4,828,260 * 5/1989 Todd ..... 473/521
4,948,131 * 8/1990 Nakanishi ..... 473/521
5,071,125 * 12/1991 Shen ..... 473/521
5,219,166 * 6/1993 Chang ..... 473/521
5,236,198 * 8/1993 Haines et al. ..... 473/521
5,599,018 * 2/1997 Radel ..... 473/521

FOREIGN PATENT DOCUMENTS

2503941 * 8/1976 (DE) ..... 473/FOR 181
2211857 * 7/1974 (FR) ..... 473/FOR 181
2225539 * 6/1990 (GB) ..... 473/FOR 181
2247842 * 3/1992 (GB) ..... 473/FOR 181
265206 * 3/1929 (IT) ..... 473/FOR 181
40/1259875 * 10/1989 (JP) ..... 473/FOR 181

* cited by examiner

*Primary Examiner*—Raleigh W. Chiu
(74) *Attorney, Agent, or Firm*—Hoffman, Wasson & Gitler

(57) ABSTRACT

In a ball-game racket, especially a tennis racket, with a racket head formed by a clamping frame with stringing and with a grip shaft that attaches via, for example, a core piece, a damping element is located on the racket that has at least one additional weight and is elastically mounted with gaps between it and all adjacent walls.

7 Claims, 3 Drawing Sheets

RACKET WITH DAMPING ELEMENT IN NECK AREA

BACKGROUND OF THE INVENTION

The invention relates to a ball-game racket, especially a tennis racket.

Ball-game rackets, in general, are known (DE-GM 94 13 688). In the case of the known ball-game racket, a damping element is accommodated in an additional bridge that is arranged between the two diverging bridges or frame sections that form the core piece, and are specifically vertical to the longitudinal axis of the racket-grip shaft and in the plane of the racket surface.

In the known case, the purpose of the damping element is to damp vibrations that arise in the racket, or in the vibration system, that includes the racket and the player's arm or hand, especially when during play the ball is not hit in the so-called "sweet spot", i.e., in the area of the racket stringing where during play the racket behaves "neutrally" or largely neutrally with respect to vibration behavior and tendency toward vibration.

The object of this invention is to improve a ball-game racket of the type described above with regards to the accommodation and action of the damping element.

SUMMARY OF THE INVENTION

In the racket according to the invention, there is provided at least partially visible, a damping element on the racket or racket frame.

In one possible embodiment of the ball-game racket according to the invention, on the side facing toward the core piece of the grip shaft, a damping element is located in a recess that is accessible from the core piece.

The embodiment according to the invention has numerous advantages. The process of mounting the damping element is simplified. In addition, it is also possible to make the damping element replaceable in a particularly simple way.

In the case where the recess is located at the transition between the core piece and the grip shaft, the damping element is provided in a zone which during play is exposed to especially intense stress. Because the damping element is located in this zone, it is especially effective. Having the racket designed with the core piece between the grip shaft and clamping frame also ensures that the recess is readily accessible from the core piece.

BRIEF DESCRIPTION OF THE FIGURES

The invention is explained in greater detail using the following figures.

DETAILED DESCRIPTION OF THE INVENTION

Figure 1:
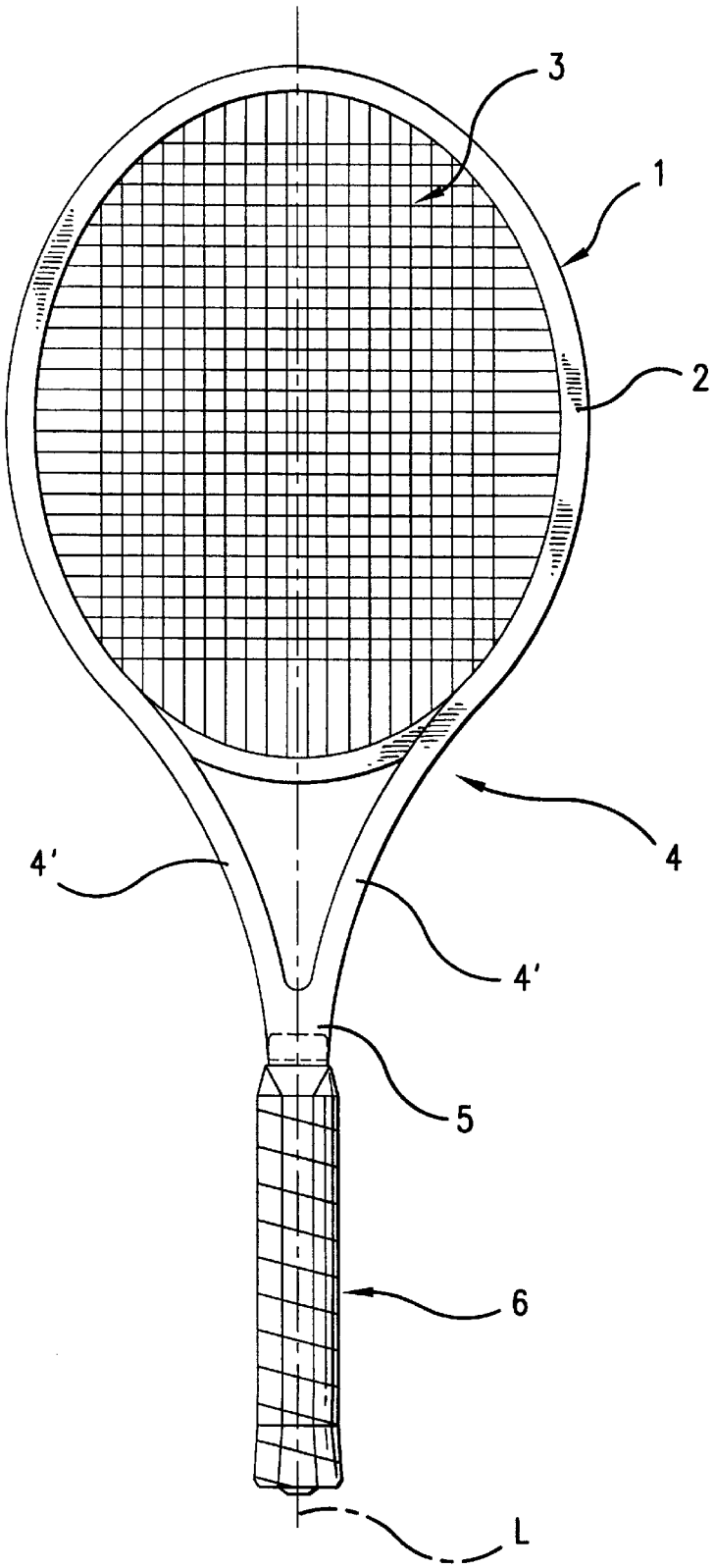
FIG. 1 shows a racket in the shape of a tennis racket, top view.
Figure 2:
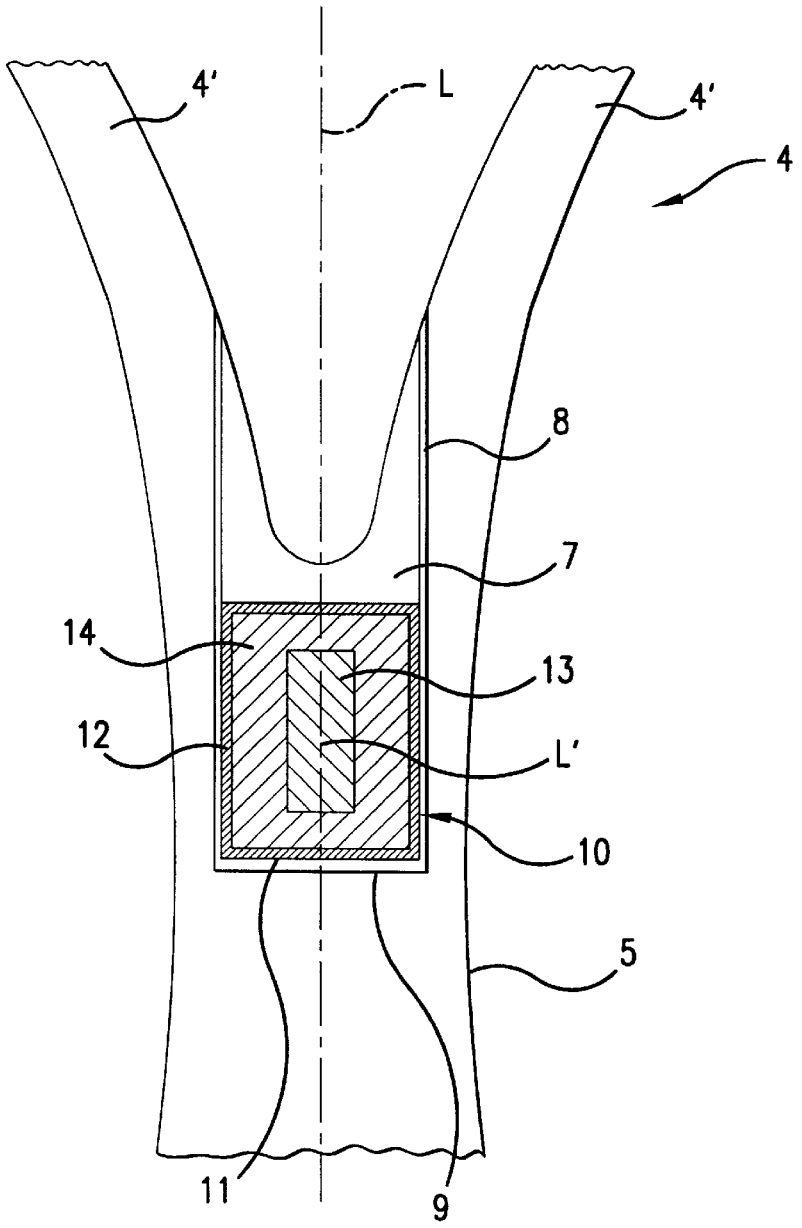
FIG. 2 shows the racket in an enlarged partial view, together with a damping element that is arranged in the racket grip shaft.

The tennis racket, shown in the figures, has a racket head 1 with clamping frame 2 and racket stringing 3 that is provided there. There is a racket neck or racket grip shaft 5 which connects to the clamping frame 2 via a core piece 4 and which forms the gripping part of the racket and on which a handle 6 is also provided. In clamping frame 2, core piece 4, which is formed by two bridges or arms 4' that extend from grip shaft 5 and diverge, as well as grip shaft 5, form a one-piece racket frame that is produced as a cavity or hollow frame, which is closed to the outside and is made of a suitable material, for example, fiber-reinforced plastic, i.e., over its entire length it has a hollow profile that is closed to the outside.

In the embodiment shown, a special feature lies in the fact that in grip shaft 5 there is an opening 7 on the side that faces core piece 4, whereby said opening, in the embodiment presented, is designed with a closed peripheral wall 8 and a closed floor 9 and, with peripheral wall 8, also extends part way into the sides of bridges 4' that face each other. Opening 7 and peripheral wall 8, as well as their extensions in the area of bridges 4' and floor 9, are designed in such a way that the hollow frame is also closed to the outside in the area of opening 7. Opening 7 lies with its longitudinal axis L in a line with the axis of grip shaft 5 and thus also in the plane that is defined by racket stringing 3. In the embodiment shown, axis L is also the axis of symmetry of the tennis racket.

A damping element 10 is inserted into the opening 7, which is open toward core piece 4 and, in the embodiment shown here, this is done in such a way that said damping element 10 is replaceable. Damping element 10 consists of an external cylindrical housing 11, which in the embodiment shown is designed to be adapted to the cross-section of opening 7 and is closed at both ends. Housing 11 is made of a hard plastic, for example, fiber-reinforced plastic, or plastic reinforced with carbon fibers. The damping element is firmly secured, i.e., so that it does not wobble, in the opening 7 with the aid of a corresponding means in opening 7 and to the outer surface of housing 11. If housing 11 is designed in the shape of a regular cylinder, to attach it in recess 7, it is equipped with external threading 12 which is designed as, for example, a self-tapping thread and, when damping element 10 is inserted or installed, it cuts into the peripheral wall of opening 7 or into a section that is specially provided there for external threading 12, for example, a ring-shaped projection 8'. Peripheral wall 8 or the above-mentioned area 8' of the peripheral wall are made of a plastic that is somewhat softer than that of housing 11.

In the inside of the housing 11, an additional weight 13 is elastically mounted with gaps on all sides between it and the inner surface of the housing. This is accomplished by virtue of the fact that the additional weight which, in the embodiment shown, is formed by a rod-like body that is arranged in the same axis as the housing 11, is made of a material with a high specific gravity, and is embedded in a damping elastic mass 14 which, in the embodiment depicted, fills up the inside of housing 11. The mass weight of the additional weight 13 is, for example, on the order of approximately 2–30 g. The material that is used as the weight 14 is, for example, a plastic with elastic properties or restoring properties, for example, a foam or foam rubber with a restoring behavior of >7 msec.

The additional weight, as well as the damping material are selected with allowance for the eigenfrequency of the tennis racket in such a way that, when the tennis racket is swung, a relative motion takes place between the additional weight and the racket and in this process the energy of these vibrations is obliterated in the damping material 14. Owing to the damping element 10 and the additional weight 13, which is mounted in damping material 14, and owing to the damping, i.e., energy-obliterating properties of material 14, vibrations in the tennis racket or tennis racket frame are effectively damped and player comfort is considerably enhanced. Such vibrations arise in the tennis racket and racket frame especially when during play the ball is hit or struck outside of the so-called "sweet spot" of stringing 3.

The improved playing behavior manifests itself in, among other things, readily controllable hitting of the ball even outside of the "sweet spot" and in a better ball feel. The damping of the vibrations and the tendency of the racket to vibrate also reduces the physical burden on the player.

As indicated above, the damping element 10 is replaceable. This makes it possible, when the material 14 ages, and there is consequently a significant loss of damping action, to completely replace the damping element 10 with a new damping element. It is also possible, for example, when buying a new tennis racket, to select from a wide variety of damping elements that are standardized but have different properties. The damping element 10 can be selected that is optimum for the player in question and for the corresponding tennis racket and properties which may change due, for example, to changes in the strength of the stringing.

Figure 3:
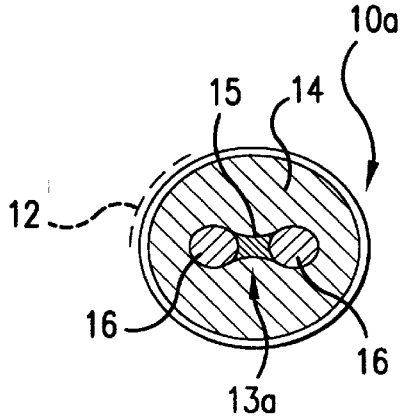
FIG. 3 shows a section through another embodiment of the damping element.

The additional weight 13 of the damping element 10 can be designed in the shape of a rod. FIG. 3 shows in simplified form, and in section, another possible embodiment of a damping element 10*a* in which the additional weight 13*a* is formed by a body that consists as one piece of two partial weights 16 that are connected together via a bridge 15, whereby the weight 13*a* is in turn designed and arranged to be symmetrical to longitudinal axis L' of the damping element 10*a*. The partial weights 16 are, in turn, e.g., rods that are connected together by a through bridge 15. This design has the advantage that the additional weight 13*a* has a high moment of inertia relative to the longitudinal axis L' of the damping element 10*a*, and thus, in particular, torsional vibrations around longitudinal axis L are effectively damped.

There also exists the option of providing as the additional weight several independent individual weights in the housing 11 and to have them embedded in the damping material 14 and, for example, in separate housing chambers.

Because each damping element 10 is arranged in the recess 7, which is located at the end of shaft 5 that is adjacent to core piece 4, the damping element is provided at the point where the largest deformations arise when the tennis racket is used in play. Because the racket is designed with a core piece 4 and with two bridges 4', it is possible to locate the open side of the opening 7 at the core piece 4 in such a way that it is possible to insert the damping element 10 or 10*a* into the opening 7 as well as to remove the damping element from the opening via the space that is formed between the two bridges 4'.

Figure 4:
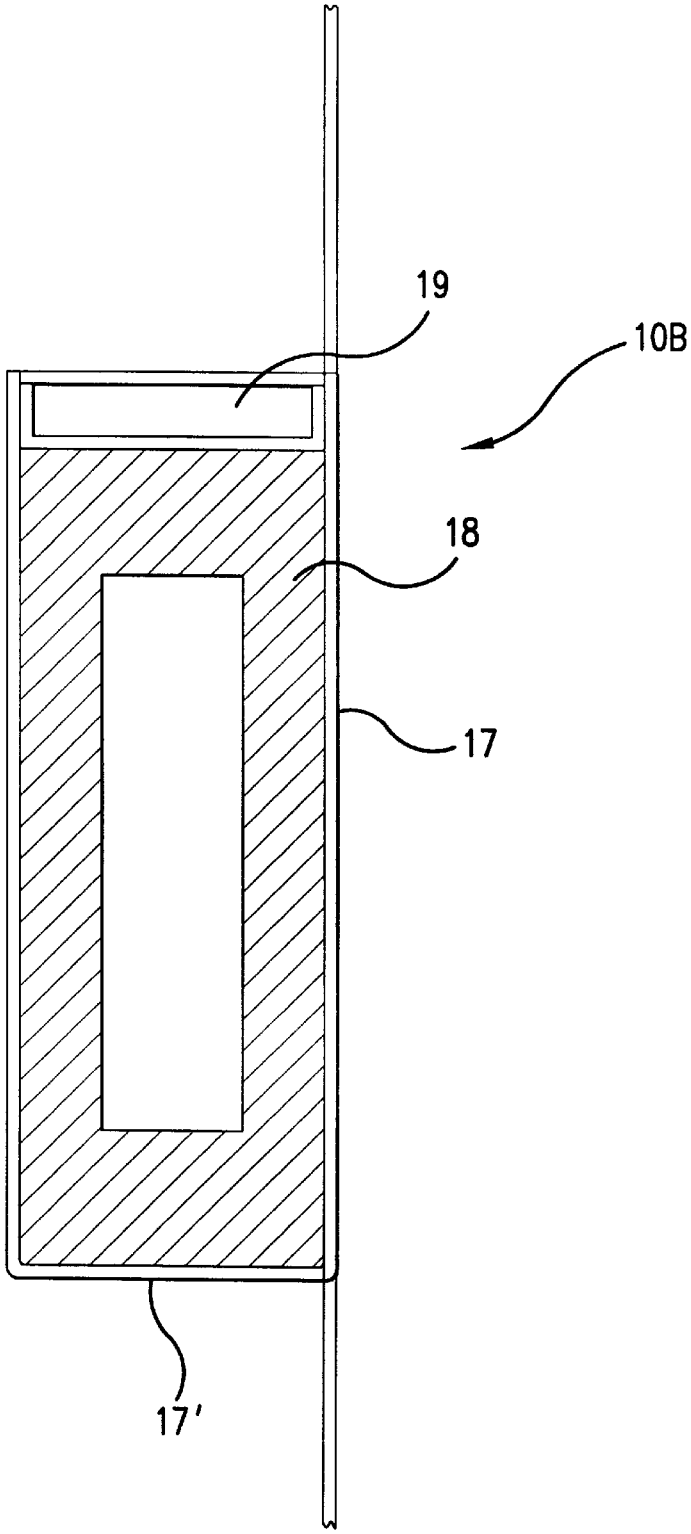
FIG. 4 shows a longitudinal section through another damping element.

FIG. 4 shows another damping element 10*b* whose housing consists of a sleeve 17 with a floor 17', whereby the sleeve is made of metal, for example, aluminum, by deep drawing. A shaped body 18 that is made of an elastic foam rubber is inserted into the sleeve 17 under pre-stress. The foam rubber encases the additional weight 13. The additional weight, the restoring behavior of the foam rubber, and the pre-stress are matched in such a way that damping is achieved. This is optionally adapted to the eigenvibration behavior of the racket. With the shaped body 18 kept the same size, different sleeve sizes and sleeve diameters make it easy to distinguish different levels of pre-stress and damping elements 10*b* with different properties. The different sleeve sizes and sleeve parameters also make it easy to distinguish damping elements 10*b* with different properties. Shaped bodies 18 can be easily produced by cutting or stamping them out from a foam-rubber material. The sleeve 17 is closed by an inserted cover 19. As shown in FIG. 1, the damping element 10*c* can also protrude from the racket so that it is at least partially visible.

The invention was described above based on an embodiment. Numerous modifications and variations are possible without thereby exceeding the basic inventive thought that underlies the invention.

REFERENCE LIST

1 racket head
2 clamping frame
3 stringing
4 core piece
4' bridge
5 racket neck or racket grip shaft
6 handle
7 opening
8 peripheral wall
9 floor
10, 10*a* damping element
11 housing
12 external threading
13, 13*a* additional weight
14 elastic and damping material
15 bridge
16 partial weight
17 sleeve
17' floor
18 shaped body
19 cover

What is claimed is:

1. A ballgame racket comprising:

a racket head that is formed by a clamping frame with stringing;

a grip part that connects to the clamping frame and is formed by a grip shaft or a racket neck;

a handle;

a damping element that is provided on the racket neck that has at least one additional weight that is elastically mounted with a gap on all sides between it and adjacent walls, wherein the damping element consists of a sleeve into which an elastic damping material that surrounds the at least one additional weight is inserted under pre-stress and whereby the damping element protrudes from the racket and is at least partially visible.

2. The ballgame racket according to claim 1, wherein the grip part is connected to the clamping frame via a core piece whereby the core piece is formed by two bridges that extend with one end from the grip shaft and diverge, and with the other end making a transition to the clamping frame and whereby a recess is formed in the grip shaft that is open toward the core piece or toward a space between the two bridges that is to accommodate the damping element that is located in the recess.

3. A ballgame racket comprising:

a racket head that is formed by a head frame, with stringing;

a grip part that adjoins to the head frame via a core piece, the core piece is formed by a grip shaft or a racket neck with a handle;

the core piece having a damping element that has at least one additional weight that is elastically mounted therein with a gap on all sides between it and adjacent walls, whereby the core piece is formed by two bridges that extend with one end from the grip shaft and diverge, and with the other end making a transition to the head frame, whereby in the grip shaft a recess is formed which is open toward the core piece or toward the space between the two bridges and which is to accommodate the damping element that is located in the recess, whereby the damping element consists of a sleeve into which an elastic damping material that surrounds an additional weight is inserted under pre-stress.

4. The ballgame racket according to claim 3, wherein the sleeve is deep drawn from a metal or is made of plastic.

5. The ballgame racket according to claim 3, wherein the sleeve is made integral with a floor.

6. A ballgame racket comprising:

a racket head that is formed by a head frame, with stringing;

a grip part that adjoins to the head frame via a core Piece and is formed by a grip shaft or a racket neck with a handle;

the core piece having a damping element that has at least one additional weight that is elastically mounted therein with a gap on all sides between it and adjacent walls, whereby the core piece is formed by two bridges that extend with one end from the grip shaft and diverge, and with the other end making a transition to the head frame, whereby in the grip shaft a recess is formed which is open toward the core piece or toward the space between the two bridges and which is to accommodate the damping element that is located in the recess, wherein the at least one additional weight is held in an elastic damping material or in a damping material with restoring force.

7. The ballgame racket according to claim 6, wherein the damping material is a foam or a foam rubber.

* * * * *